United States Patent [19]

Epstein et al.

[11] 3,956,729

[45] May 11, 1976

[54] COUNTERMEASURES APPARATUS

[76] Inventors: David Epstein; Sidney Epstein, both of 3611 Flatlands Ave., Brooklyn, N.Y. 11234

[22] Filed: May 12, 1964

[21] Appl. No.: 367,608

[52] U.S. Cl. ..... 340/5 D; 340/3 E; 343/18 E

[51] Int. Cl.[2] ..... H04K 3/00

[58] Field of Search ..... 340/2, 3, 5, 5 D, 6, 340/3 E; 343/18, 18 E

[56] References Cited

UNITED STATES PATENTS

| | | | |
|---|---|---|---|
| 2,397,107 | 3/1946 | Hammond, Jr. | 35/25 |
| 2,938,483 | 5/1960 | Mason | 114/20 |
| 2,949,089 | 8/1960 | Reid | 114/21 |
| 3,126,544 | 3/1964 | Greatbatch, Jr. | 343/18 |
| 3,150,848 | 9/1964 | Lager | 343/18 X |
| 3,180,295 | 4/1965 | Niederer | 114/20 |

*Primary Examiner*—Richard A. Farley

EXEMPLARY CLAIM

1. A method of deceiving passive correlation measuring apparatus comprising the step of reradiating a plurality of substantial replicas of the target noise signature so separated as to provide a plurality of discrete correlatable signals for reception by said passive correlation measuring apparatus.

6 Claims, 3 Drawing Figures

COUNTERMEASURES APPARATUS

This invention relates to a countermeasures system and more particularly to an underwater countermeasures system to confound and mislead passive correlation localization systems.

Recent advances in the development of operational passive correlation measuring systems have pointed up the need for methods of countering the systems. Briefly, the new countermeasures (CM) system works on the following principle: By re-radiating delayed replicas of its own self-noise signature, from a repeater located locally (aboard own ship) or at a distance (remotely), from a decoy or another ship acting as a decoy, the noise generating ship (hereinafter called the target) under surveillance by a passive correlation measuring system can create the illusion of a plurality of targets thereby rendering accurate location of the true target very difficult. The method of this invention has decided advantages over prior art systems which utilize decoy noise makers to simulate false targets; particularly systems wherein the generated noise is statistically independent of the target noise and therefore does not unduly confuse passive correlation localization systems, i.e., both true target and real noise maker are "seen." The degree of confusion engendered is proportional to the number of dispersed targets presented to the listener's passive correlation system.

It is the object of this invention to provide a method and apparatus to deceive passive correlation type bearing, ranging, and depth determination systems by effectively "blanketing" listener's passive correlation localization device read-out with a multiplicity of dispersed targets. In general, all but one of said multiplicity of targets will correspond to real or phantom decoys, mostly phantom.

Amongst the broad aspects of the invention is the re-radiation of the target's broad-band (*bb*) noise signature by a plurality of decoy repeaters.

Another aspect of this invention is the simultaneous re-radiation of time-delayed replicas of the target's noise signature to create a plurality of false targets from each decoy.

Still another aspect of the invention includes the re-radiation of replicas of the target noise signature which contain only selected narrow band portions of the broad band target noise signature. Such "spectrum sampling" would be advantageous if the generation of sufficiently strong (comparable in intensity to the acoustic power radiated by the true target) broad band replicas by a decoy is not feasible. Since the noise statistics are preserved in a linear filtering operation, these narrow-band (nb) portions correlate with that portion of the original bb spectrum from which they were obtained. Thus the location of the listener's correlation peaks remains unaltered, but the fine structure of the spurious correlation functions may vary from peak to peak.

Still another feature is the use of well-known two-dimensional visual data-read-out devices such as a cathode ray tube to show the predicted relative locations of listener, target, decoy(s), and spurious targets as "seen" by the listener. The use of one or more additional two-dimensional displays would give a three-dimensional presentation if desired. Parenthetically, a number of three-dimensional displays have been developed and may be used for this purpose. With the aid of the predicted visual display, the CM operator may (1) give instructions to re-position target and decoy vis-a-vis listener, (2) re-adjust the electronic time delays of the noise replicas, (3) adjust the magnitude of noise replicas relative to target noise, to best advantage and to suit the particular situation at hand.

The usual shipboard data aquisition equipments are used to give estimates of target's, decoy's, and listener's position, motion, heading, and aspect. This information is fed into a computer which is programmed to predict the positions of the target and spurious targets relative to the listener. The computer then generates the predicted target pattern, as would be seen by the listener, and superimposes the pattern on a suitable coordinate system (i.e., a range-azimuth grid, a lat.-long. grid, etc.). The listener is assumed to have a passive correlation measuring system of known capabilities. The parameters of the target and decoy (position, motion, etc.) are known accurately and subject to the CM operators control, but the listener's parameters are estimates and subject to error. Nevertheless, the predicted display gives the CM operator a good idea as to what the listener will see when he studies the output presentation of his passive surveillance equipment; namely, the target, the decoy, and the spurious targets.

The above-mentioned and other features and objects of the invention will become more apparent by reference to the following description taken in conjunction with the accompanying drawings in which.

Figure 1:
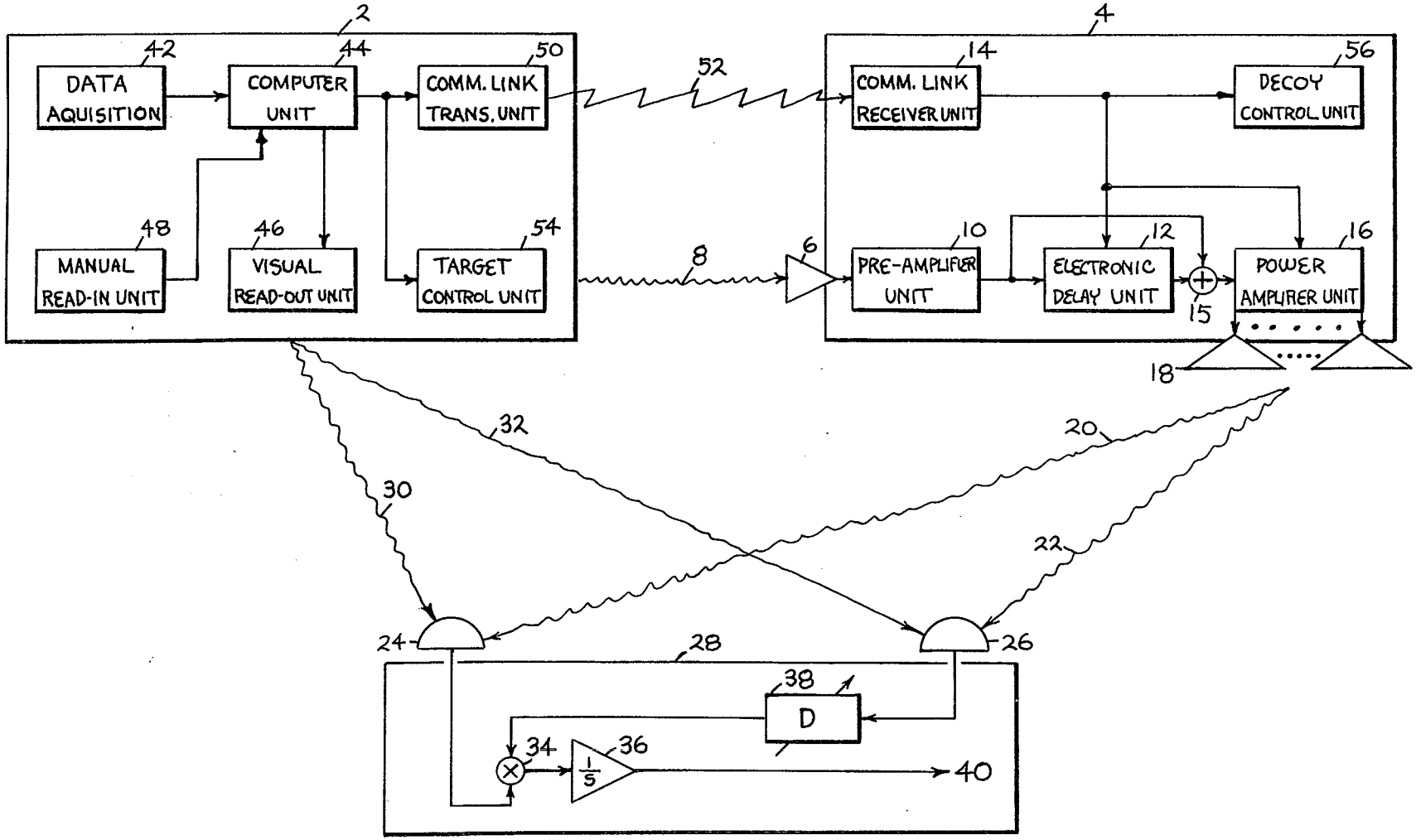
FIG. 1 illustrates schematically a countermeasures system incorporating the principles of the invention including therein, for completeness, a representative listener passive correlation bearing determination apparatus.

For illustrative purposes, an embodiment of the subject invention comprising a target and a remote decoy will be described in conjunction with FIG. 1. The target 2 normally radiates acoustic energy (target noise signature) omnidirectionally through the medium, which in this case is water. The target signature arrives at the decoy 4 through hydrophone 6 delayed by the time it takes to traverse the path 8. The electrical replica of target signature is pre-amplified 10 and fed to the variable electronic delay unit 12, which typically might be a constant velocity endless magnetic tape with a fixed recording head and an adjustable reproducing head to provide the desired delay. The variable delay adjustment is controlled via the communication link 52 to receiving unit 14. The output of delay unit 12 is a replica of the target noise signature, delayed in time by the water delay plus the electronic time delay. This replica is summed with the direct output of 10 (delayed in time by the water delay only) at the summation point 15. The linear superposition of the two (not restricted to two) delayed replicas of the target noise signatures are then fed to the power amplifier unit 16 which performs the usual amplifying, filtering, load sharing and matching functions. The output of 16 is also controlled via the communication link receiving unit 14. The output of 16 is fed to a bb transducer or a plurality of nb transducers 18. The usual precautions are taken to prevent excessive feedback from transducers 18 to hydrophone 6. The delayed, re-radiated replicas of the target signature are propagated in the water along rays 20 and 22 to the listener's hydrophones 24 and 26, respectively, located on listener ship 28.

The noise signature of target 2 propagates along rays 30 and 32 and also appear at the listener's hydrophones 24 and 26; but, due to interference amongst the noise signal from true target 2 and its delayed replicas from real decoy 4, crosscorrelation, instead of yielding a single correlation peak, from which the target's bearing could be directly obtained, yields many peaks, all but one corresponding to a false bearing. Should the listener's apparatus include additional hydrophones (not shown in FIG. 1) to determine additional bearings from which range and depth could be deduced, the effect of the re-radiated replicas is to create the illusion of a multiplicity of widely dispersed targets in space. A basic passive correlation listener apparatus, with bearing determination capability only, is exemplified by the hydrophones 24 and 26, a multiplier unit 34, an averaging unit 36, and a variable time delay unit 38. The correlogram would appear on line 40.

The data aquisition unit 42 continually monitors target data aquisition equipment of interest, e.g., motion, position, and aspect of target, decoy, and listener. The raw data is fed to the on-line computer unit 44 which is programmed to predict the results of listener's attempt to put the target under passive correlation surveillance. The predicted result is continuously readout of the computer via the visual read-out unit 46 (the man-machine interface) in a form suitable for human evaluation. As an example of apparatus which includes conventional elements such as the data aquisition unit 42, on-line computer 44 and visual read-out unit 46, reference may be had to the Anti-Submarine Attack Plotter described in Sect. 28C3 of "Naval Ordnance and Gunnery, Vol. 2, Fire Control," U.S. Government Printing Office, Washington, D.C. (1958). FIG. 28C5 on page 399 of said publication shows a cathode ray tube type of read-out with a typical two-dimensional geographical model of a tactical situation presented thereon. As is conventional in such apparatus, the true target 2, real decoy 4 and listener 28 location and movement data are converted into compatible electrical voltage variables by a data aquisition unit to a form suitable for manipulation by conventional analog and/or digital circuitry techniques, well-known to practitioners of the simulation art. In a like manner, the additional equations required to modify said Attack Plotter so as to also give it a defensive capability are incorporated therein.

Thus, such a unit could be readily adapted to accept and utilize the parameters herein of concern. For example, the electro-mathematical model there shown which simulates the actual tactical situation at hand, could also utilize as inputs, in addition to the aforementioned variables, the CM system parameters such as the time delays between the true target noise signature and the replicas from the decoys. The CM operator manipulates the various system parameters under his control via the manual read-in unit 48.

Referring again to FIG. 28C5, ibid., page 399, the scope face would now show the positions of real decoy(s) 4 in addition to the positions of own ship 2 and listener 28 (called "Target" thereon).

As before, and with no loss of generality, further description of the CM system operation is limited to the case wherein listener's passive correlation localization equipment has a bearing determination capability only. In addition to the attack aid guide lines shown on FIG. 28C5, inbid., page 399, CM guide lines could be programmed to emanate radially from listener's position to indicate predicted bearings of own ship 2, real and phantom decoys as "seen" by listener 28. Additionally, for convenience, own ship predicted bearing line may be distinctively tagged. For example, in the detailed explanation of CM system operation as it pertains to Mode of Operation No. 3, to be presented later, listener's direction finding correlation equipment would yield a correlogram 40 which indicates seven target bearings. Under such conditions, the scope face 46 would show seven radial lines originating from point occupied by listener. As mentioned earlier, the listener parameters may be subject to error, but the CM operator may readjust pertinent controls to realign said set of predicted bearing lines so that the true bearing line contains own ship as a point. In practice, the CM operator would observe the progress of the tactical situation on the plotter's scope 46. This information would assist him to set electronic time delays and deploy his decoys so as to maximize listener's confusion as to the true location of own ship. Instructions concerning the remote decoy are digitally encoded and transmitted to the decoy by the communication link transmitter unit 50, via the transmission link 52, to the communication link receiver unit 14. The transmission link 52 may be sonic or electromagnetic. Control over the movement of the decoy is exercised by the decoy control unit 56. Instructions concerning target parameters are sent to the local parameter control unit 54.

System could be automated by substituting a machine-machine interface for the man-machine interface and programming desired stratagies.

Modes of Operation

Figure 2:
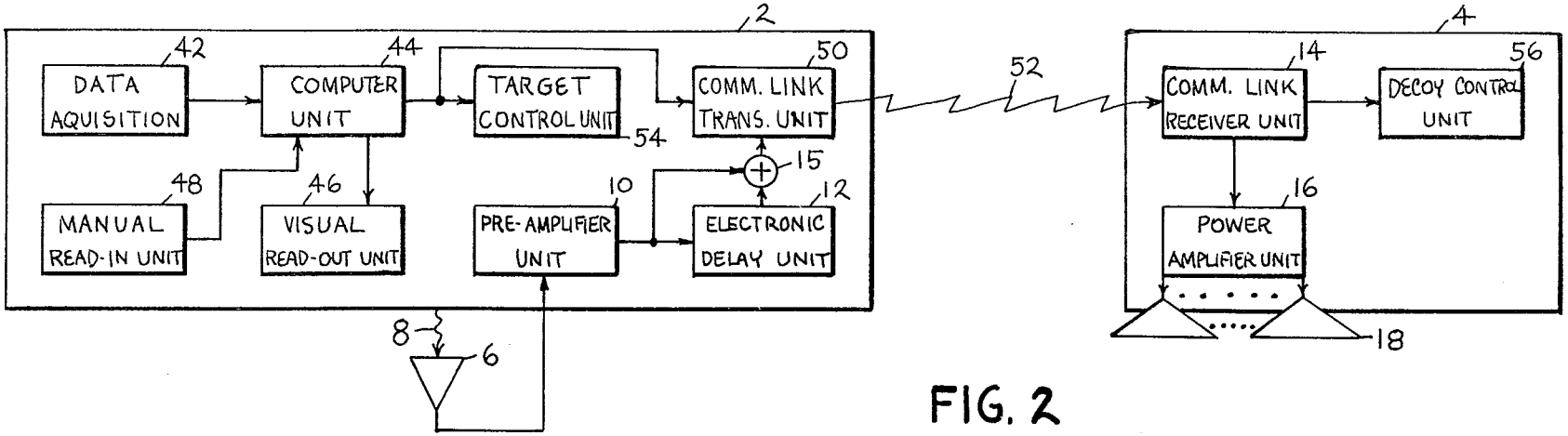
FIG. 2 illustrates schematically an alternate embodiment of the invention including means of eliminating the "water delay" as a parameter.

There are a number of ways that the target-decoy concept could be implemented; viz, 1. Target tows or otherwise controls a true decoy. This embodiment may take several forms. One such has been described in detail and is shown in FIG. 1, and another is shown in FIG. 2.
2. When two ships operate together, one may act as the decoy for the other. Each ship requires a complete target-decoy installation, but one ship exercises control over the CM operation in a master-slave relationship. This mode of operation is readily extended to a plurality of ships.
3. Target acts as its own decoy. In this embodiment, equipment formerly located on decoy 4 is now located on target 2. Certain modifications to the embodiment shown in FIG. 1 have to be made to implement this concept. The required changes are incorporated into FIG. 3 and described below.

Since target and decoy are one and the same, 2 and 4 represent the same ship. Communication link 52 now becomes simply an interior data link. Transmission channel 8 is considerably shorter than it was formerly since hydrophone 6 is now located at the target ship.

This last statement is of considerable practical importance. A class of passive correlation measuring systems operate by making a correlogram from short noise records, in the order of tens of milliseconds. Therefore, water delays must be reduced to a small fraction of said short time averaging period. By locating hydrophone 6 at the target, the water delay is effectively eliminated.

As a matter of fact, water delay can also be eliminated as a factor for modes of Operation Nos. 1 and 2.

In essence, the noise signature is recorded at the target, delayed and transmitted, electromagnetically, to the decoy. Referring to FIG. 2 note that it is similar to FIG. 1 modified to the extent that the hydrophone 6 is mounted at the target and units 10, 12, and 15 are located within the target. Transmission channel 8 and the consequent water delay are therefore small and can be ignored. The output of the summing amplifier 15 must now share transmissions over the communication link 52 with the relatively infrequent decoy-command output of the computer 44. Since, now, 'instantaneous' transmission is required, 52 is constrained to be an electromagnetic link.

Figure 3:
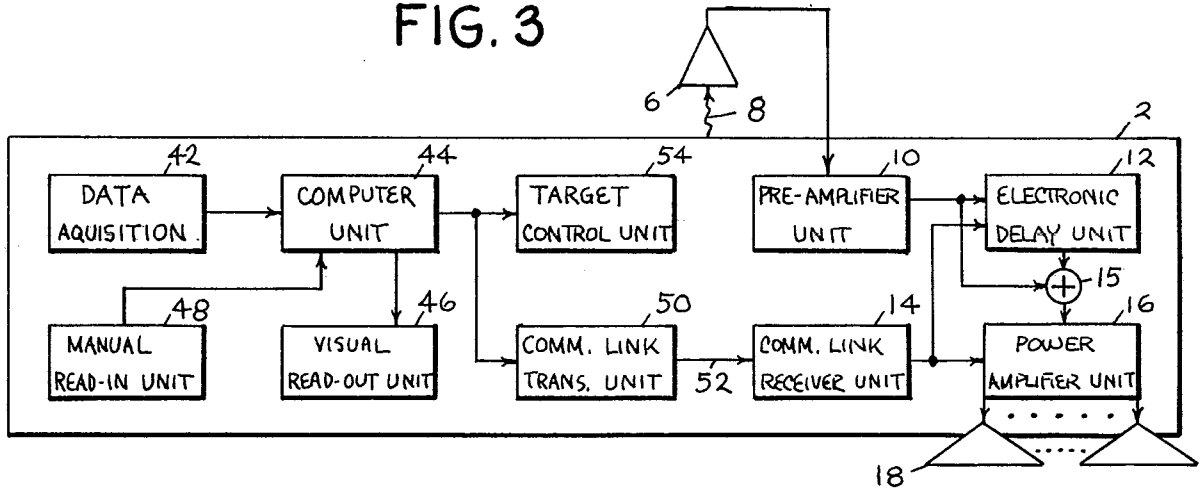
FIG. 3 illustrates schematically another embodiment of the invention including means of allowing the target to act as its own decoy.

The following illustrative example explains CM Mode of Operation No. 3; and with some modification it is readily extended to further explain Modes of Operation Nos. 1 and 2 also. For the purposes of this analysis, assume zero water delay and two electronic delays 12, $d_1$ and $d_2$. Referring to FIG. 3, an electronic delay unit 12 is inserted in the line intermediate preamplifier unit 10 and summer unit 15. As before, listener ship 28 has a modern passive correlation bearing determination capability as exemplified on FIG. 1. The most successful of these systems utilize polarity coincident clipper correlators which are based on apparatus disclosed by V.C. Anderson in "Delay Line Time Compressor," U.S. Pat. No. 2,958,039 issued Oct. 25, 1960.

Let the true target noise signature signal be described analytically by the symbol $s(t)$. Because the true target 2 and the real decoy 4 are now one and the same vessel, the composite target noise signature signal (prime plus delayed secondary replicas) reaching listener hydrophone No. 1, 24, is $$y_1(t) = s(t-t_1) + s(t-t_1-d_1) + s(t-t_1-d_2) \quad (1)$$

where $t_1$ represents the propagation time of the target noise signature from own ship to listener's hydrophone No. 1 along water path 20, say; the composite signal reaching hydrophone No. 2, 26, along path 22 is $$y_2(t) = s(t-t_2) + s(t-t_2-d_1) + s(t-t_2-d_2) \quad (2)$$

Note that in the special case of Mode of Operation No. 3, path 30 merges with path 20 and path 32 merges with path 22. It is understood that both sonic signals, $y_1(t)$ and $y_2(t)$, are detected and converted to electrical signals by suitable broad band sonar receivers. Signal $y_2(t)$ is delayed "$\tau$" seconds by listener's delay unit 38 to give $$y_2(t-\tau) = s(t-t_2-\tau) + s(t-t_2-d_1-\tau) + s(t-t_2-d_2-\tau) \quad (3)$$

Equ. 3 is multiplied by $y_1(t)$ via multiplier unit 34 and time averaged by unit 36 over a finite noise record. Repeating this process over and over in "fast" time yields the cross-correlation function 40,

$$R_{y_1 y_2}(\tau) = \overline{y_1(t) y_2(t-\tau)} \quad (4)$$

In this example, Equ. 4 will peak at the following seven listener delay times:

$$\begin{aligned}
\tau &= (t_1-t_2) \\
\tau &= (t_1-t_2) - d_1 \\
\tau &= (t_1-t_2) + d_1 \\
\tau &= (t_1-t_2) - d_2 \\
\tau &= (t_1-t_2) + d_2 \\
\tau &= (t_1-t_2) - (d_1-d_2) \\
\tau &= (t_1-t_2) + (d_1-d_2)
\end{aligned} \quad (5)$$

In general, there will be $$m^2 + m + 1 \quad (6)$$

targets "blanketing" listener's read-out indicator, where "$m$" equals the number of delayed target noise signature replicas reradiated (in this case, $m = 2$). Of the multiplicity of targets specified by Equ. 6, $$m^2 + m \quad (7)$$

represent phantom decoys.

Let the linear distance between listener's hydrophones 24 and 26 be designated by "$L$" and the angle between path 20 and said line "$L$" by "$\theta$"; from the geometry, the listener's delay times, $\tau$, as listed under Equ. 5, are related to the bearing angles, $\theta$, by the formula $$\theta = \cos^{-1}(c\tau/L) \quad (8)$$

where "$c$" represents the velocity of sound in water. Thus, the resulting listener's correlation bearing pattern yields seven bearings. Of the seven, the last six (Equ. 5) correspond to spurious targets; in this instance, all six represent phantom decoys. In practice, the resulting multiplicity of widely strewn targets "seen" by listener coupled with signal processing noise, environmental additive water noise and multiplicative fading will obscure the identity of the true target and render its localization difficult, if not impossible.

While we have described above the principles of our invention in connection with specific apparatus, it is to be understood that this description is made only by way of example and not as a limitation to the scope of our invention as set forth in the objects thereof and in the accompanying claims.

We claim:

1. A method of deceiving passive correlation measuring apparatus comprising the step of reradiating a plurality of substantial replicas of the target noise signature so separated as to provide a plurality of discrete correlatable signals for reception by said passive correlation measuring apparatus.

2. The method as set forth in claim 1 wherein said separation is effected by the step of delaying the reradiation of at least one of said replicas of said target noise signature by a predetermined time interval.

3. The method as set forth in claim 1 wherein said separation is effected by the step of reradiating at least one of said replicas of said target noise signature from a location disposed remote from the point of generation of said target noise signature.

4. Apparatus for deceiving passive correlation measuring systems comprising means for generating a plurality of substantial replicas of the target noise signature and means for separately reradiating said replicas to provide a plurality of discrete correlatable signals for reception by said passive correlation measuring apparatus.

5. Apparatus as set forth in claim 4 wherein said substantial replicas comprise narrow band portions of the broad band spectrum of said target noise signature.

6. Apparatus for deceiving passive correlation measuring systems comprising pick up means for converting the target noise signature into a prime electrical replica thereof, means for converting said electrical replica into a plurality of discrete secondary electrical replicas thereof separated in the time domain and means for sonically reradiating said secondary electrical replicas to provide a plurality of discrete correlatable signals for reception by said passive correlation measuring apparatus.

* * * * *